US012618260B1

(12) United States Patent
Bergsma

(10) Patent No.: US 12,618,260 B1
(45) Date of Patent: May 5, 2026

(54) FENCE AND GATE SYSTEMS AND METHODS FOR USE

(71) Applicant: Larry Bergsma, Marblemount, WA (US)

(72) Inventor: Larry Bergsma, Marblemount, WA (US)

( * ) Notice: Subject to any disclaimer, the term of this patent is extended or adjusted under 35 U.S.C. 154(b) by 364 days.

(21) Appl. No.: 17/650,556

(22) Filed: Feb. 10, 2022

Related U.S. Application Data

(60) Provisional application No. 63/265,009, filed on Dec. 6, 2021.

(51) Int. Cl.
*E04H 17/14* (2006.01)
*E04H 17/16* (2006.01)

(52) U.S. Cl.
CPC ..... *E04H 17/1465* (2021.01); *E04H 17/1417* (2013.01); *E04H 17/161* (2013.01); *E04H 17/168* (2013.01)

(58) Field of Classification Search
CPC . E04H 17/161; E04H 17/163; E04H 17/1465; E04H 17/168; E04H 17/1469
See application file for complete search history.

(56) References Cited

U.S. PATENT DOCUMENTS 3,363,390 A * 1/1968 Crane ..... E06B 3/22 52/800.14
3,770,245 A * 11/1973 Murdock ..... E04F 11/1851 256/65.08
3,822,053 A * 7/1974 Daily ..... E04F 11/1817 403/263
3,997,144 A * 12/1976 Parisien ..... E06B 11/02 160/371
4,132,390 A * 1/1979 Pfarr, Jr. ..... E04H 17/163 256/73
4,508,320 A * 4/1985 Hegarty ..... E06B 11/04 256/60
5,551,205 A * 9/1996 Kidder ..... E04H 17/163 52/716.8
6,283,456 B1 * 9/2001 Benz ..... E04H 17/163 256/73
7,478,797 B2 * 1/2009 Laws ..... E04H 17/168 52/316
8,596,619 B2 * 12/2013 Volin ..... E06B 11/021 256/73
2003/0038282 A1 * 2/2003 Forbis ..... E04H 17/1417 256/65.1

(Continued)

FOREIGN PATENT DOCUMENTS

DE 102009037977 A1 * 4/2012 ..... E04G 21/3238
FR 2660003 A1 * 3/1990 ..... E04H 17/163
FR 2888271 A1 * 1/2007 ..... E04H 17/161

*Primary Examiner* — Michael P Ferguson
(74) *Attorney, Agent, or Firm* — Schacht Law Office, Inc.; Michael R. Schacht; Bronte Brillantes

(57) ABSTRACT

A fence system comprises a rail assembly, a post assembly, and a panel insert. The rail assembly comprises at least two rails, and each rail defines at least one rail opening. The post assembly comprises a plurality of posts arranged to support the rails. The panel insert is arranged such that portions of the panel insert extend through at least one of the at least one rail opening in at least one of the at least two rails such that the panel insert is supported by the rail assembly.

18 Claims, 6 Drawing Sheets

(56) References Cited

U.S. PATENT DOCUMENTS

| | | | | |
|---|---|---|---|---|
| 2004/0245512 | A1* | 12/2004 | Naegele | E04H 17/168 256/47 |
| 2009/0194753 | A1* | 8/2009 | Stucker | E04H 17/1417 256/64 |
| 2011/0127482 | A1* | 6/2011 | Lo | E04H 17/1417 256/68 |
| 2016/0305151 | A1* | 10/2016 | Bodrogi | E04H 17/163 |

* cited by examiner

FENCE AND GATE SYSTEMS AND METHODS FOR USE

RELATED APPLICATIONS

This application, U.S. patent application Ser. No. 17/650,556 filed Feb. 10, 2022, claims benefit of U.S. Provisional Application Ser. No. 63/265,009 filed Dec. 6, 2021, the contents of which are incorporated herein by reference.

TECHNICAL FIELD

The present invention relates to a fence and gate system.

BACKGROUND

Traditional fence and gate systems include numerous metal fasteners that help to connect the rails to the posts. The fasteners are necessary to provide stability to the fence structure. However, these fasteners are subject to corrosion from exposure to the outdoor elements. Corrosion of the fence fasteners can destabilize the structure and require costly repairs and/or replacement of parts of the fence system. Further, conventional methods of properly fabricating, assembling, and securing fences can be time consuming and thus costly.

The need thus exists for improved fence systems and methods that are easier to assemble and minimize the likelihood of improper assembly and/or reduce the need for replacement fencing due to environmental conditions that adversely affect the materials and fastener systems.

SUMMARY

The present invention may be embodied as a fence system comprising a rail assembly, a post assembly, and a panel insert. The rail assembly comprises at least two rails, and each rail defines at least one rail opening. The post assembly comprises a plurality of posts arranged to support the rails. The panel insert is arranged such that portions of the panel insert extend through at least one of the at least one rail opening in at least one of the at least two rails such that the panel insert is supported by the rail assembly.

The present invention may also be embodied as a method of forming a fence system comprising the following steps. At least two rails are provided, and at least one rail opening is formed in each rail. A plurality of posts are provided. The at least two rails are supported on the plurality of posts. A panel insert is arranged such that portions of the panel insert extend through at least one of the at least one rail opening in each of the at least two rails such that the panel insert is supported by the at least two rails.

The present invention may also be embodied as a fence system comprising at least first and second rails, at least first and second posts, and a panel insert. Each of the first and second rails defines at least one rail opening. The at least first and second posts are arranged to support the rails. The first and second rails are configured such that each of the first and second rails grips portions of the one panel insert that extend through at least one of the at least one rail opening in each of the first and second rails.

DETAILED DESCRIPTION

The present disclosure provides a fence system 10. The present fence system 10 is a new design which uses a unique process for joining multiple different materials without requiring the use of fasteners into a fence that is virtually maintenance free and has a significantly greater longevity, thus reducing the cost and the environmental impact.

Figure 1:
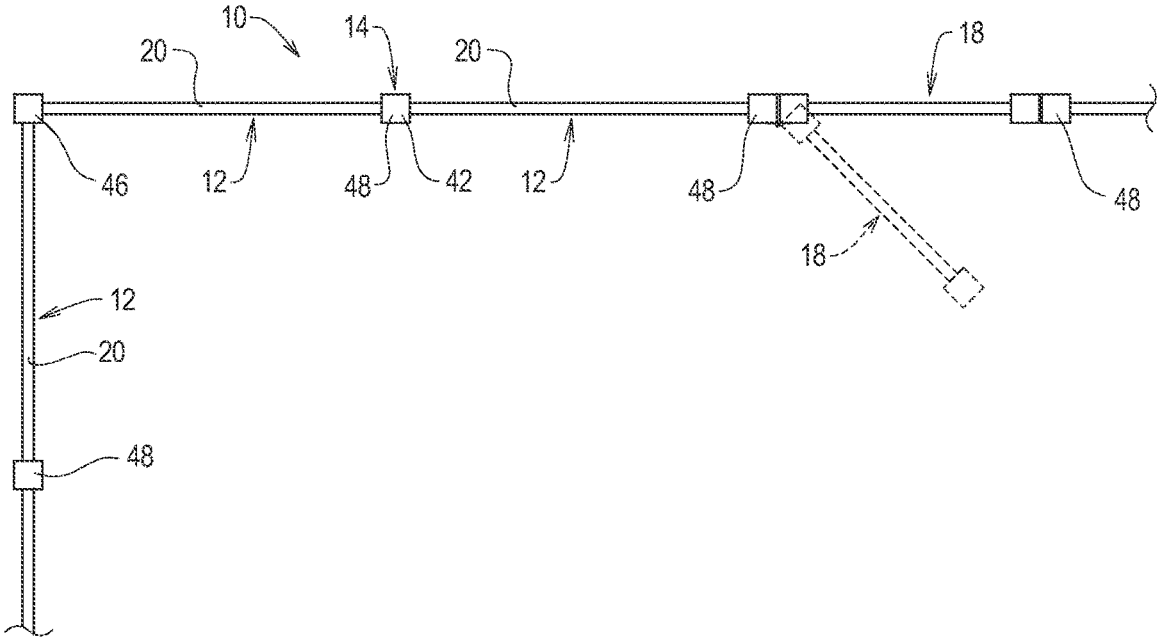
FIG. 1 is a top plan view of a first example fence system of the present invention.
Figure 2:
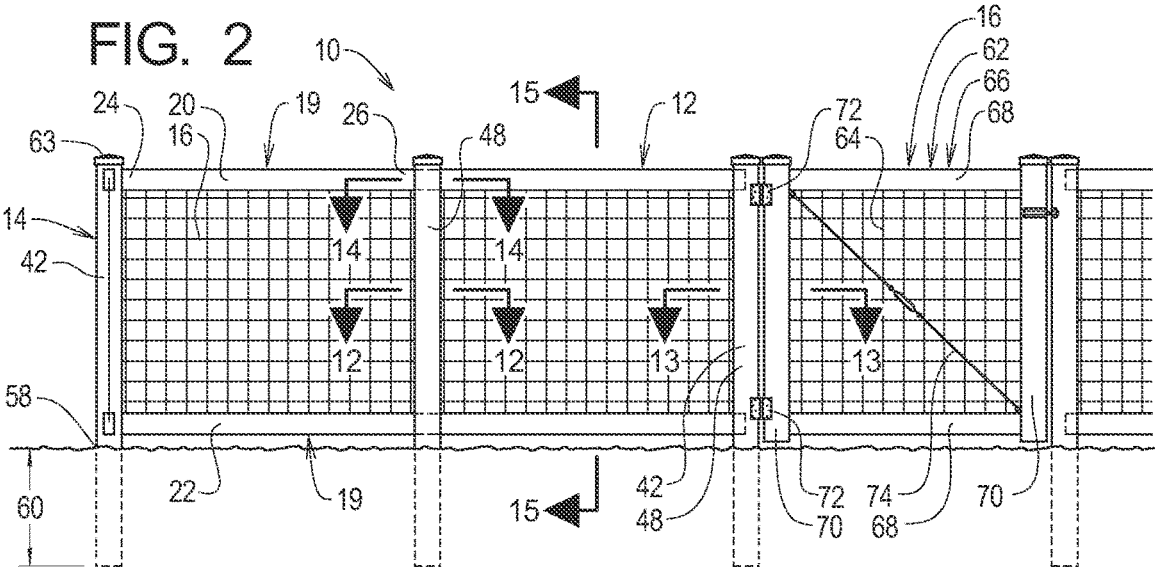
FIG. 2 is a side elevation view of the example fence system.

The example fence system 10 includes a rail assembly 12, a post assembly 14, a mesh rail insert 16, and a gate assembly 18. Referring to FIGS. 1 and 2, the example rail assembly 12 includes a plurality of horizontal rails 19 comprising a top horizontal rail 20 and a bottom horizontal rail 22. In some examples, the rail assembly 12 may include multiple sets of horizontal rails 19.

The example top rail 20 and the example bottom rail 22 are typically maintained in a position substantially parallel to the ground and substantially parallel to each other. The top rail 20 and the bottom rail 22 are preferably of substantially similar size, shape and construction. The top rail 20 and the bottom rail 22 of the rail assembly 12 may be made in any conventional manner and may be cut to any length necessary to maintain the strength and stability of the fence system 10. In some examples, the lengths of the top and bottom rails 20 and 22 do not exceed 8 linear feet. Also, the rail assembly 12 may be made of any conventional material, including vinyl, steel, or aluminum. In some examples, the rail assembly 12 may be made of vinyl. In other examples, the rail assembly 12 is made of steel or aluminum.

Figure 5:
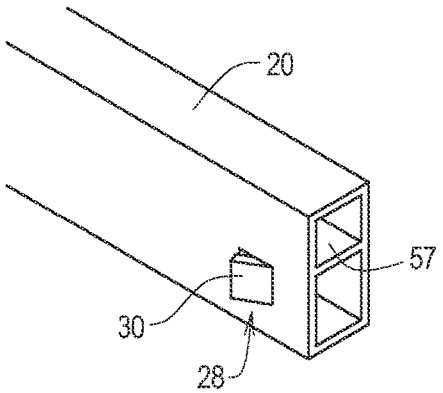
FIG. 5 is a side perspective view of an example securing assembly on an example first end of an example upper horizontal rail.
Figure 6:
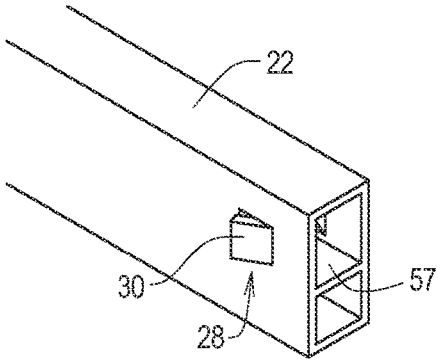
FIG. 6 is a side perspective view of the example securing assembly on an example second end of the example lower horizontal rail.
Figure 14:
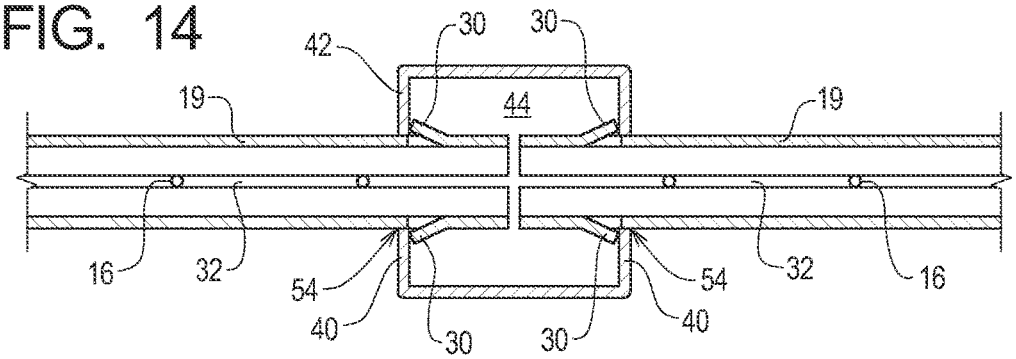
FIG. 14 is a section view taken along lines 14-14 in FIG. 2.

As shown in FIG. 2, each of the horizontal rails 19 have a first end 24 and a second end 26. The first and second ends 24, 26 of the horizontal rails 19 are configured to be securely attached to the post assembly 14, via a securing system or assembly 28. Referring to FIGS. 5 and 6, the example securing system 28 comprises at least one depressible tab 30 located near the first and second ends 24, 26 of the top rail 20 and near the first and second ends 24, 26 of the bottom rail 22. During installation, the depressible tabs 30 are pressed to allow entry of the first and second ends 24, 26 of the horizontal rails 19 into the corresponding top opening 54 and bottom opening 56 in the vertical posts 42 of the post assembly 14. The depressible tabs 30 may also include a spring (not pictured) that assists the retraction of the depressible tabs 30. As shown in FIG. 14, the top rail 20 and the bottom rail 22 of the rail assembly 12 are secured when the depressible tabs 30 engage with an interior 44 of the vertical posts 42. The depressible tabs 30 are released within the interior 44 and locked in place, thus allowing the horizontal rails 19 to be securely installed. In order to remove the rail assembly 12 from the post assembly 14, the depressible tabs 30 are pressed and released from the interior 44 of the vertical posts 42. The depressible tabs 30 are disengaged and the rail assembly 12 can be removed from the post assembly 14.

Figure 9:
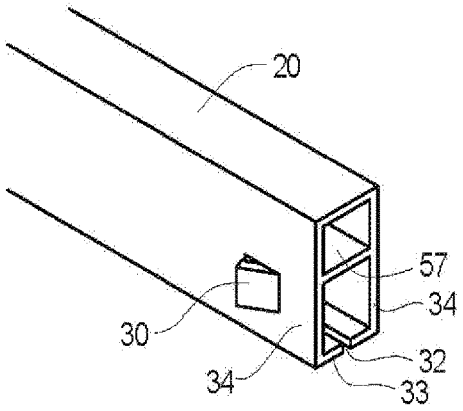
FIG. 9 is a side perspective view of an example side of the upper horizontal rail.
Figure 16:
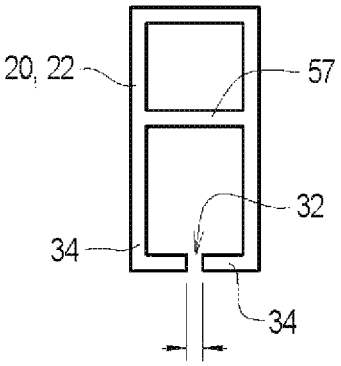
FIG. 16 is an end view of a rail illustrating the slot opening in a preferred width ready to receive the mesh rail insert.
Figure 17:
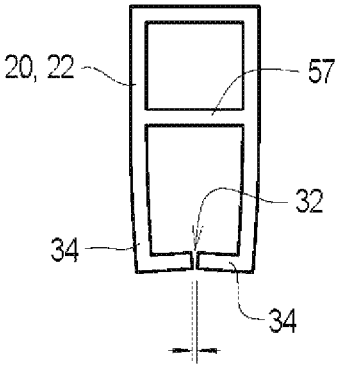
FIG. 17 is an end view of a rail after the slot has been cut illustrating the tendency of the side walls to deflect inwardly.

Referring again to FIGS. 9 and 10, the rail assembly 12 is securely attached to the mesh rail insert 16 via elongated rail openings 32 that are cut into an inner side 33 of the horizontal rails 19, proximate to the mesh rail insert 16. Each of the elongated rail openings 32, extend longitudinally along the length of the horizontal rails 19. The purpose of the elongated rail openings 32 is to attach the mesh rail insert 16 to the fence system 10 without the need for fasteners. The elongated rail openings 32 may have a length and a thickness that is substantially similar to a length and thickness of the mesh rail insert 16. As shown in FIGS. 16 and 17, the elongated rail openings 32 create two adjacent flaps 34 in the horizontal rails 19 surrounding each of the elongated rail openings 32. Once the mesh rail insert 16 passes through the elongated rail openings 32 into the interior of the horizontal rails 19, the adjacent flaps 34 engage or otherwise clamp the mesh rail insert 16 such that portions of the mesh rail insert 16 are held tightly within the elongated rail opening 32 to secure the mesh rail insert 16 relative to the horizontal rails 19.

The length and width of the elongated rail openings 32 may vary depending on several factors, including the length and thickness of the mesh rail insert 16. The elongated rail openings 32 may be a thin slit whose length and width is substantially similar to the length and a width of the mesh rail insert 16. In some examples, the elongated rail openings 32 may be about 4 feet. Making these specific cuts on the horizontal rails 19 to create the elongated rail openings 32 advantageously eliminates the use of fasteners and simplifies the design and installation. This design feature also reduces the need for costly repair due to environmental conditions.

Figure 15:
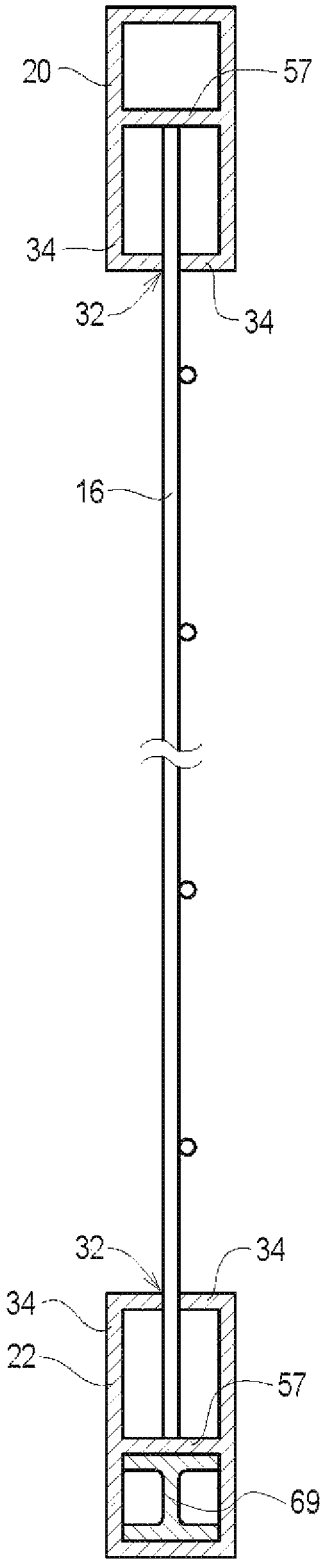
FIG. 15 is a section view taken along lines 15-15 in FIG. 2.

Referring again to FIG. 15, the horizontal rails 19 may also include an interior barrier 57. The addition of the interior barriers 57 provides a boundary for how deep the mesh rail insert 16 may be inserted into the top rail 20 and the bottom rail 22.

Referring again to FIG. 2, the post assembly 14 includes a plurality of vertical posts 42. The plurality of vertical posts 42 includes at least two end posts 46 and, typically, at least one intermediate post 48. In some examples, the plurality of vertical posts 42 may include more than two end posts 46 depending on the shape and configuration of the fence system 10. The plurality of vertical posts 42 may also include a more than one intermediate posts 48. The number of end posts 46 and the intermediate posts 46 is determined by the length of the fence system 10 and is chosen in a conventional manner to provide structure and stability to the fence system 10.

Figure 3:
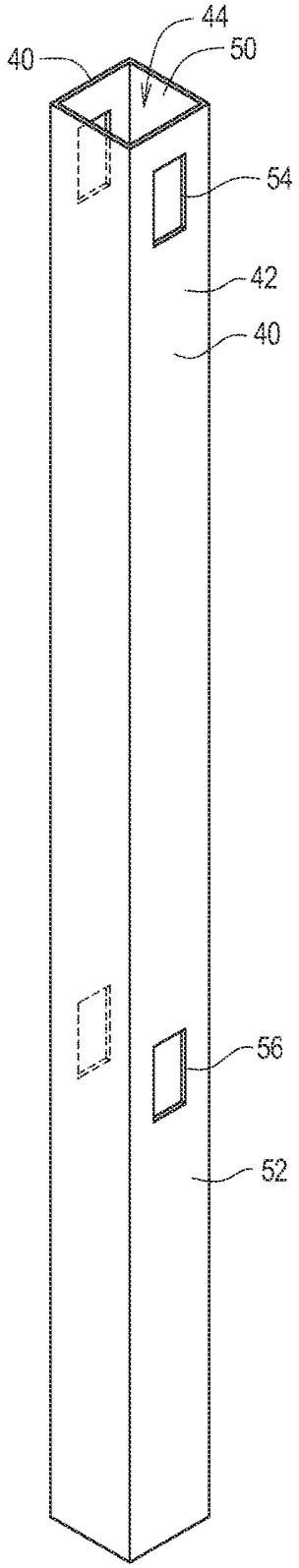
FIG. 3 is a side perspective view of an intermediate post of the example fence system.

The vertical posts 42 of the post assembly 14 may be made in any conventional manner and may be made out of any conventional material, including vinyl, steel or aluminum. In some examples, the post assembly 14 may be made of vinyl. In other examples, the post assembly 14 is made of steel or aluminum Referring to FIGS. 3-4, each of the plurality of vertical posts 42 includes a top end 50 and a bottom end 52. The top rail(s) 20 is configured to securely attach to top ends 50 of the vertical posts 42 via a top opening 54. The top opening 54 can receive the first end 24 or the second end 26 of the top rail 20, interchangeably. The bottom rail(s) 22 is configured to securely attach to bottom ends 52 of the vertical posts 42 of via a bottom opening 56. The bottom opening 56 can receive the first end 24 or the second end 26 of the bottom rails 22, interchangeably.

The top opening 54 and the bottom opening 56 are generally similarly spaced along each of the plurality of vertical posts 42. The spacing between the top opening 54 and the bottom opening 56 is chosen in any conventional manner to provide structure and stability to the fence system 10. As illustrated in FIG. 2, the spacing between the top opening 54 and the bottom opening 56 of the vertical posts 42 is substantially similar to the height of the mesh rail insert 16.

Referring to FIG. 14, the top rail 20 and the bottom rail 22 are secured to the vertical posts when the depressible tabs 30 are released and passed through the top opening 54 or the bottom opening 56. The depressible tabs 30 are secured when they are locked in place within the interior 44 of the vertical posts 42. In order to remove the top rail 20 and the bottom rail 22 from the top openings 54 and the bottom openings 56, the depressible tabs 30 are pressed and released from the interior 44 of the vertical posts 42. The depressible tabs 30 are disengaged and the top rail 20 and the bottom rail 22 can be removed from the post assembly 14.

Figure 4:
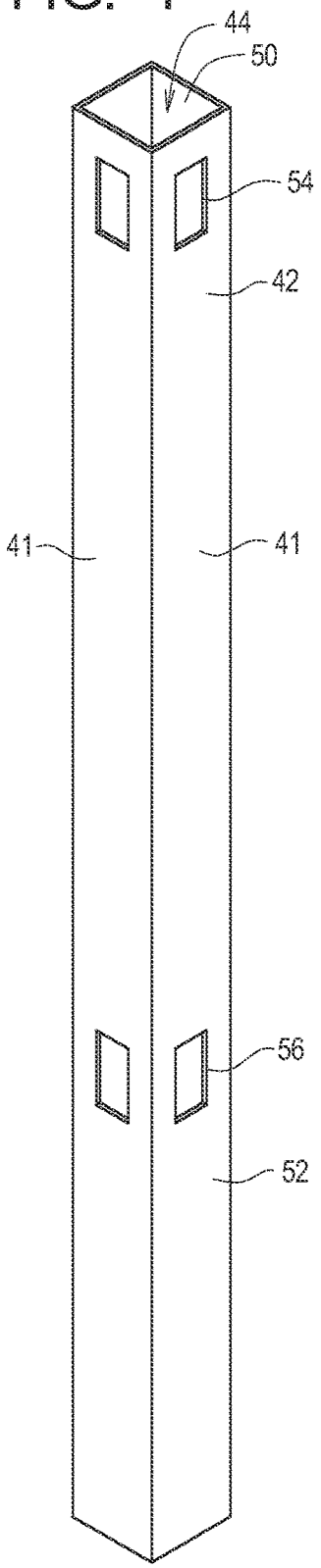
FIG. 4 is a side perspective view of a corner post of the example fence system.

Each vertical post 42 is configured to accommodate at least one top rail 20 and at least one bottom rail 22. In some examples, the vertical posts 42 can accommodate at least two top rails 20 and at least two bottom rails 22. For example, the intermediate post 48 is configured to receive two top rails 20 and two top rails 22, as shown in FIGS. 1 and 2. In this case, the two top rails 20 and the two bottom rails 22 are secured to opposing sides 40 of the intermediate posts. In another example, the end post 46 may receive two top rails 20 and two bottom rails 22. As shown in FIG. 4, the top rails 20 and the bottom rails 22 are secured to adjacent sides 41 of the vertical posts 42.

Figure 13:
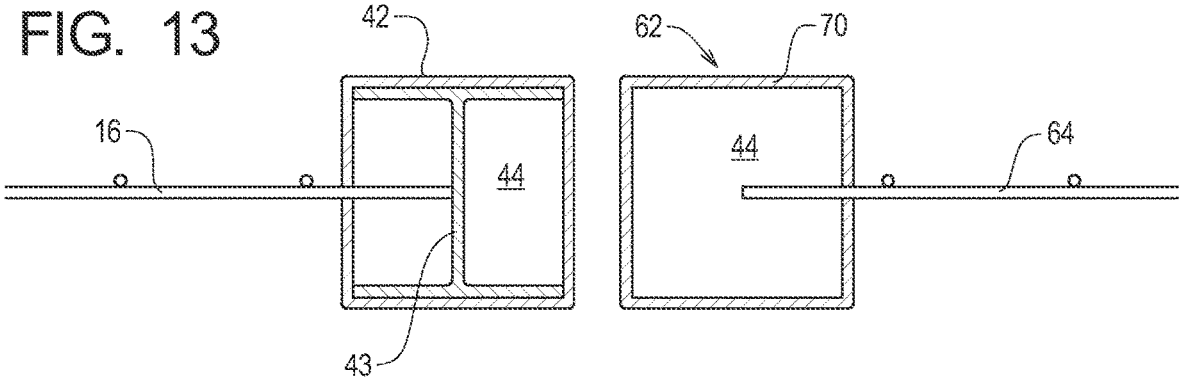
FIG. 13 is a section view taken along lines 13-13 in FIG. 2.

As shown in FIG. 13, the vertical posts 42 may also include an optional interior structural member 43. If used, the structural member 43 is driven into the ground and extends at least partly up through the posts 42 to help maintain the posts 42 in a vertical orientation.

Referring again to FIG. 2, the vertical posts 42 are set into a ground location 58 at a depth 60 below the bottom end 52 of the vertical posts 42. The ground location 58 is chosen in order to stabilize the fence system 10. The depth 60 of the vertical posts 42 may be chosen based on the width and length of the vertical posts. In some embodiments, the depth 60 of the vertical posts 42 may be at least one-third the height of the vertical posts 42. In other embodiments, the depth 60 may be greater or less than one-third the height of the vertical posts 42. The vertical posts 42 can be set into the ground location 58 using any conventional method. For example, the vertical posts 42 are set into the ground location 58 using concrete to secure and stabilize the vertical posts 42 so that they do not move or become uprooted from the chosen depth 60.

Figure 7:
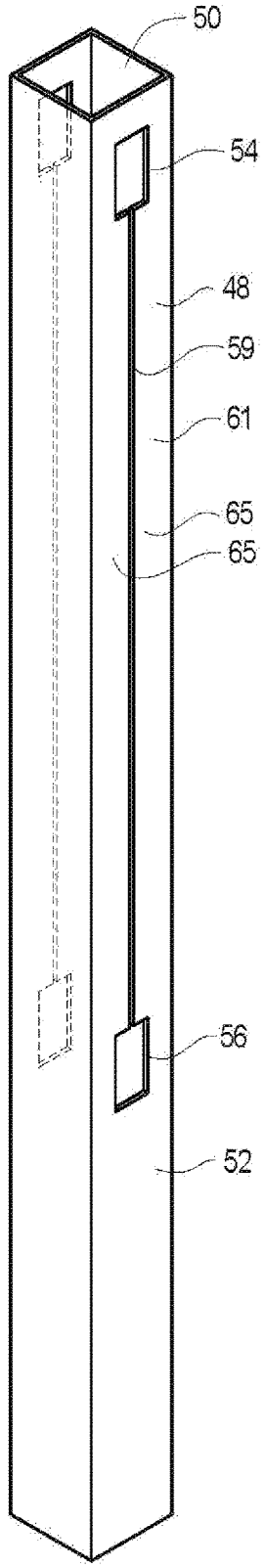
FIG. 7 is a side perspective view of an example elongated post slit of an example intermediate post.
Figure 8:
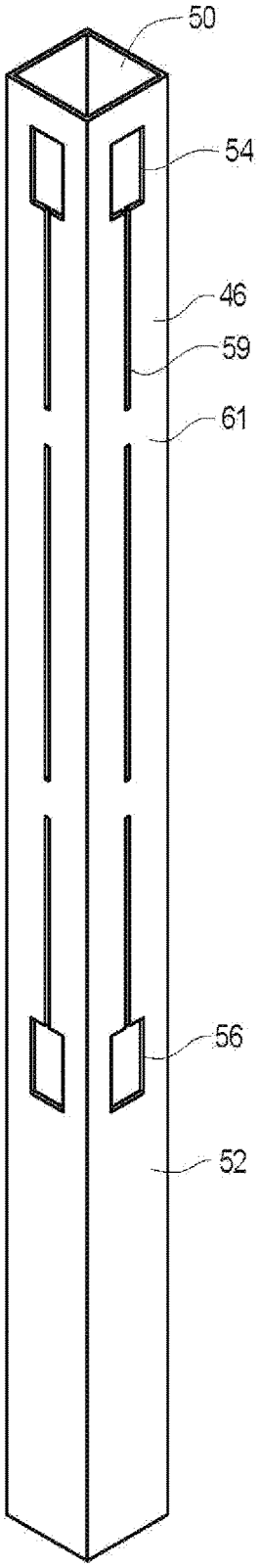
FIG. 8 is a side perspective view of an example elongated post slit of the example corner post.

Referring to FIGS. 7 and 8, the vertical posts include elongated post slits 59 configured to receive the mesh rail insert 16. Each of the elongated post slits 59, extends longitudinally along the length of the vertical posts 42, and are cut into a post side 61 proximate to the mesh rail insert 16. The purpose of the elongated post slits 59 is to attach the mesh rail insert 16 to the fence system 10 without the need for fasteners. The elongated post slits 59 create two adjacent flaps 65 in the vertical posts 42 that create an opening through which the mesh rail insert 16 enters the interior 44 of the vertical posts 42. The opening has a thickness that is substantially similar to the thickness of the mesh rail insert 16. Once the mesh rail insert 16 passes through the opening into the interior 44 of the vertical post 42, the adjacent flaps 65 engage at least a portion of the mesh rail insert 16 such that the mesh rail insert 16 tightly fits into the elongated post slits 59 such that the mesh rail insert 16 is secured relative to the vertical post 42 during normal use.

The length and width of the elongated post slits 59 may vary depending on several factors, including the height and thickness of the mesh rail insert 16 and the location of the vertical posts 42. The elongated post slits 59 may be one thin slit whose height and width is substantially similar to the height and a width of the mesh rail insert 16. In some examples, the elongated post slit 59 may be about 4 feet. When the vertical post 42 is an end post 46, the elongated post slit 59 may be divided into several short slits. For example, when the vertical post 42 is the intermediate post 48, the elongated post slit 59 may be a long thin slit having a height and width substantially similar to the height and width of the mesh rail insert 16. Making these specific cuts on the vertical posts 42 and rails to eliminate the use of fasteners and simplify the design and installation.

Referring again to FIG. 2, the vertical posts 42 further include a cap 63. The caps 63 is configured to fit above the top ends 50 of the vertical posts 42. The purpose of the caps 63 is to keep any debris, water, etc., from entering the interior 44 of the vertical posts 42. As shown in FIG. 2, the caps 63 may be substantially the same size and shape as the vertical posts 42. In some examples, however, the caps 63 may be shaped differently than the shape of the vertical posts. The caps 63 may also be made using any conventional manufacturing method and made be made from any conventional material. The material of the cap 63 will be chosen to provide a secure attachment to the vertical posts 42 and to provide an impenetrable barrier to the outside elements. Once installed, the caps 63 may be secured to the vertical posts 42 using any conventional method.

Figure 10:
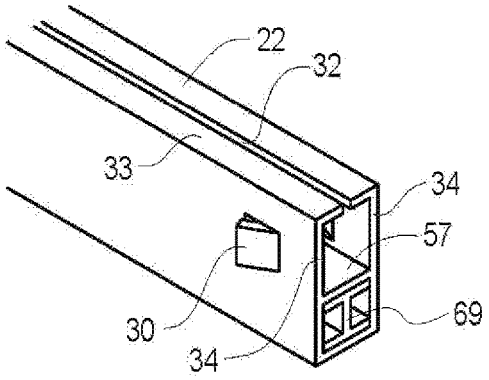
FIG. 10 is a side perspective view of elongated rail opening on an example side of the example lower horizontal rail.

FIG. 10 illustrates a stiffening member 69 arranged within the bottom horizontal rail 22. The stiffening member inhibits bowing of the lower horizontal rail 22 and thus maintains the overall shape and/or structural integrity of the bottom horizontal rail 22, mesh rail insert 16, and top horizontal rail 20 during use.

Figure 11:
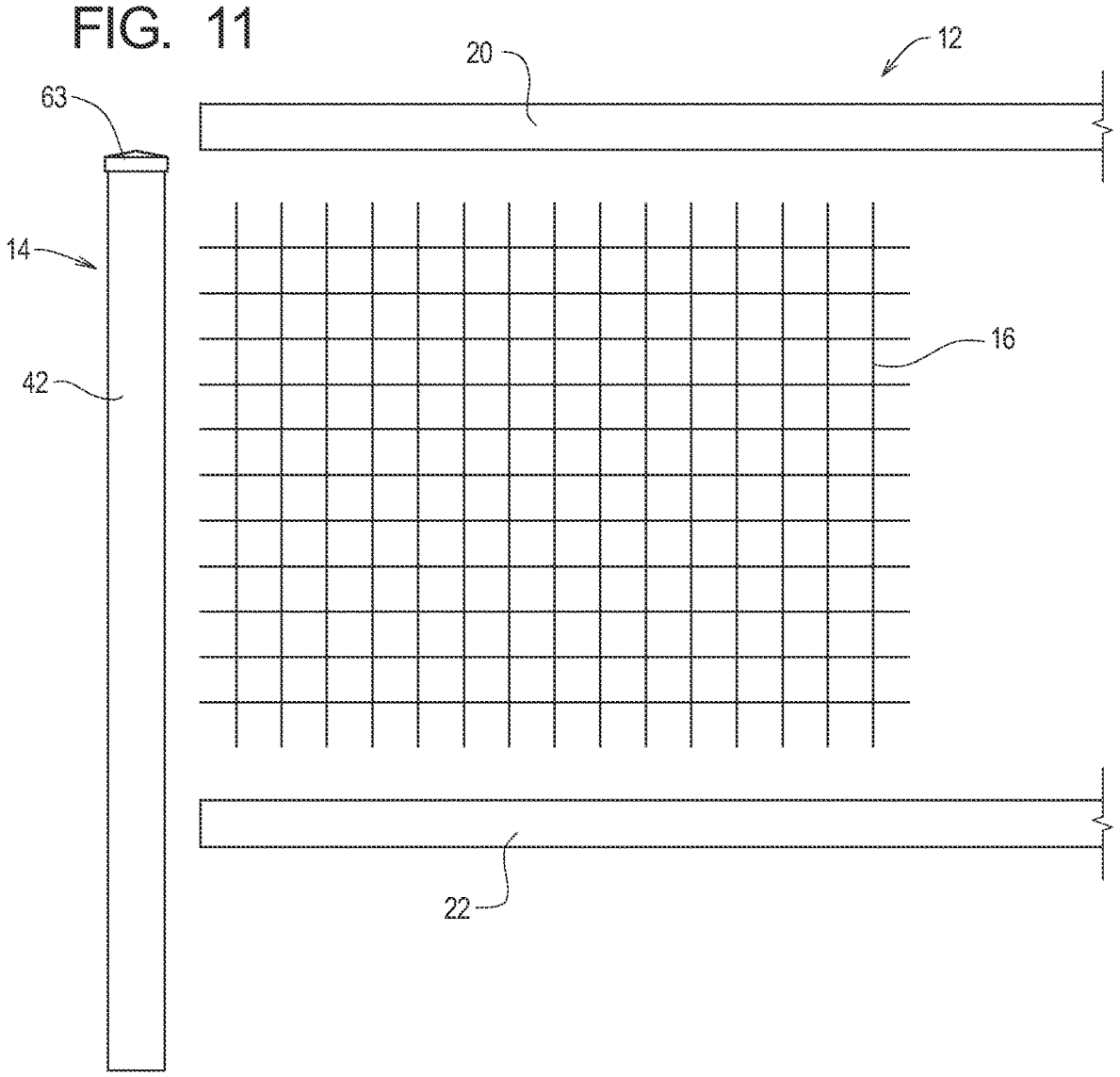
FIG. 11 is an exploded front view of the example fence system.
Figure 12:
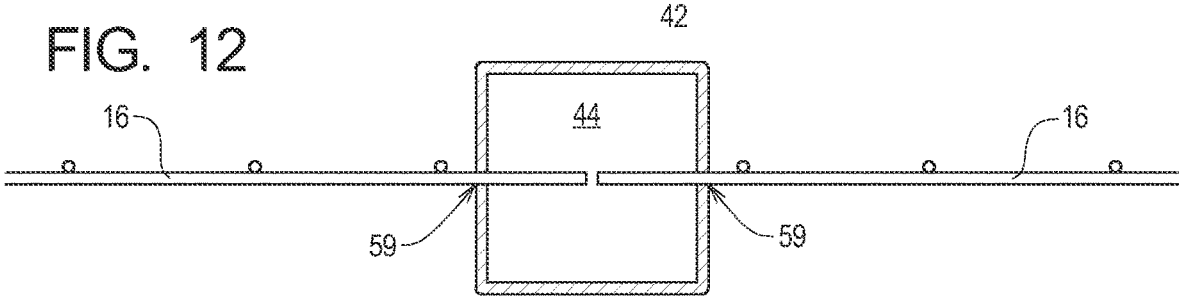
FIG. 12 is a section view taken along lines 12-12 in FIG. 2.

Referring again to FIG. 11, the mesh rail insert 16 may be made of any conventional strong material, including steel, aluminum, vinyl, bamboo, reed, or the like. In some examples, the rail mesh rail insert 16 may be made of steel. Also, the mesh rail insert 16 may be cut using any conventional manner. As stated above, the mesh rail insert 16 is sized to be substantially similar to the elongated post slits 59 along the vertical posts 42 and the elongated rail openings 32 along the top rail 20 and the bottom rail 22. In some examples, the mesh rail insert 16 is a 4 foot by 4 foot steel mesh. Additionally, as shown in FIG. 11, the mesh rail insert 16 is installed, without the need for fasteners, between the rail assembly 12 and the post assembly 14.

Referring again to FIG. 2, the fence system 10 includes the gate assembly 18 comprising a gate door 62 and a mesh panel 64. The gate door 62 includes a frame 66 having a similar height as the height of the post assembly 14. The frame 66 is formed from at least two substantially horizontal posts 68 and two substantially vertical posts 70. The horizontal and vertical posts include slits to attach the mesh panel 64. The slits function in the same way as the elongated opening and the elongated slits mentioned above.

The frame 66 may be formed from any durable material, including aluminum or steel. The substantially vertical posts 70 extend parallel to one another, and preferably are of substantially similar size, shape and construction. Similarly, the substantially horizontal rails 68 extend parallel to one another and are preferably of substantially similar size, shape and construction. The frame 66 may be attached to the post assembly 14 on one side using any conventional hinged fastener 72. On the other side, the gate door 62 may include any conventional mechanical or electrical opener to allow the gate door to swing open and close, as shown in FIG. 1.

As shown in FIG. 13, the metal mesh panel 64 may be installed using slits in the vertical posts 70 and horizontal rails 68 similar to the elongated opening and elongated slits described above. The metal mesh panel 64 is installed without the need for fasteners. The mesh rail panel 64 is sized to be fit securely between the substantially vertical posts 70 and the substantially horizontal rails 68 and can be made of any conventional strong material, including aluminum and steel.

Referring again to FIG. 2, the gate door 62 may also include a brace rod 74 attached to the mesh panel 64 and extending diagonally between the two vertical posts.

During installation, the vertical posts 42, which may be a standard blank vinyl posts, are set into the ground location 58 at the desired depth 60. The vertical posts 42 can be fixed into the desired depth 60 using any conventional method. For example, concrete can be used to fix the vertical posts 42 into the ground location 58. The number of vertical posts 42 are chosen based on the desired length of the fence system 10. Once the post assembly 14 is installed, the rail assembly 12 is connected to the post assembly 14. The horizontal rails 19 may be standard blank rails no longer than 8 linear feet. The first end 24 of the top rail 20 is inserted into the top opening 54 of the vertical post 42. Upon entry of the first end 24 of the top rail 20, the depressible tab 30 is pressed. The first end 24 of the top rail 20 is secured when the depressible tab 30 engages with the interior 44 of the vertical posts 42. The number of horizontal rail posts 19 are chosen based on the desired width of the fence system 10. Similarly, the second end 26 of the top rail 20 is inserted into the top opening 54 of a different vertical post 42. Upon entry of the second end 26 of the top rail 20, the depressible tab 30 is pressed. The second end 26 of the top rail 20 is secured when the depressible tab 30 engages with the interior 44 of the vertical posts 42.

The procedure is repeated with the first and second ends 24, 26 of the bottom rail 22. The first end 24 of the bottom rail 22 is inserted into the bottom opening 56 of the vertical post 42. Upon entry of the first end 24 of the bottom rail 22, the depressible tab 30 is pressed. The first end 24 of the bottom rail 22 is secured when the depressible tab 30 engages with the interior 44 of the vertical posts 42. Similarly, the second end 26 of the bottom rail 22 is inserted into the bottom opening 56 of a different vertical post 42. Upon entry of the second end 26 of the bottom rail 22, the depressible tab 30 is pressed. The second end 26 of the bottom rail 22 is secured when the depressible tab 30 engages with the interior 44 of the vertical posts 42.

Once the post assembly and the rail assembly are installed, the mesh rail insert 16 is attached to the rail assembly 12, via the elongated rail opening 32, and to the post assembly 14, via the elongated post slits 59. The mesh rail insert 16 is held or clamped tightly within the elongated rail opening 32 and the elongated post slit 59 allowing for a secure attachment without the need for fasteners. This design also makes it possible to eliminate the need for replacement fencing due to environmental conditions that adversely affect fastener systems. By reducing the need for fencing replacement, there is a greater reduction in environmental impact as well.

The gate system 18 is attached to one end of the post assembly 14. The frame 66 of the gate door 62 is securely attached to one of the end posts 46 using any conventional hinged fastener system. The metal mesh panel 64 may be installed using slits in the vertical and horizontal posts similar to the elongated opening and elongated slits described above. In this way, the metal mesh panel 64 is also installed without the need for fasteners.

What is claimed is:

1. A fence system comprising:

upper and lower rails, where:

each of the upper and lower rails comprises:

an elongated hollow body comprising opposing longitudinally-extending first and second side wall portions and opposing longitudinally-extending upper and lower walls defining an inner cavity, an interior barrier extending between the first and second side wall portions to define a first chamber and a second chamber, where:

a rail opening is formed in a respective one of the upper and lower walls of each of the upper and lower rails and extends into the inner cavity thereof, in which each rail opening is a slit that extends along the entire length of each of the upper and lower rails, such that portions of the respective upper or lower wall on opposing sides of the slit and extending from the first and second side wall portions of each of the upper and lower rails define first and second flaps, respectively, where the rail opening is between the first and second flaps, and each of the upper and lower rails is configured such that the first and second side wall portions deflect each of the first and second flaps inwardly towards each other;

a plurality of posts arranged to support ends of the upper and lower rails; and a panel insert; wherein:

the panel insert is arranged such that:

an upper edge portion of the panel insert extends through the rail opening in and into the first chamber of the upper rail such that:

the upper edge portion of the panel insert engages the interior barrier of the upper rail, and inward deflection of the first and second flaps by the first and second side wall portions of the upper rail grips the upper edge portion of the panel insert; and a lower edge portion of the panel insert extends through the rail opening in and into the first chamber of the lower rail such that:

the lower edge portion of the panel insert engages the interior barrier of the lower rail, and inward deflection of the first and second flaps by the first and second side wall portions of the lower rail grips the lower edge portion of the panel insert.

2. The fence system as recited in claim 1, in which each of the plurality of posts defines at least one post opening, where the panel insert is arranged such that side edge portions of the panel insert extend through at least one of the at least one post opening in first and second posts of the plurality of posts such that the side edge portions of the panel insert are supported by the first and second posts.

3. The fence system as recited in claim 2, in which at least one of the posts is configured to grip at least one of the side edge portions of the panel insert that extend through at least one of the at least one post opening.

4. The fence system of claim 2, in which each of the at least one post opening is a slit formed along at least a portion of an inner portion of each of the posts.

5. The fence system of claim 2, in which each of the at least one post opening is at least one slit formed in an inner portion of each of the posts between top and bottom openings formed in the each of the posts.

6. The fence system of claim 2, in which each of the at least one post opening is a plurality of slits formed in an inner side of each of the posts between top and bottom openings formed in the each of the posts.

7. The fence system of claim 2, in which an interior structural member is arranged within at least one of the posts.

8. The fence system as recited in claim 1, in which each of the plurality of posts comprises first and second inner portions, wherein:

at least one post opening is formed in each of the first and second inner portions of each of the plurality of posts; and first and second panel inserts are arranged such that:

a first side edge portion of the first panel insert extends through at least one of the at least one post opening in the first inner portion of a first post of the plurality of posts such that the first post supports the first side edge portion of the first panel insert; and a first side edge portion of the second panel insert extend through at least one of the at least one post opening in the second inner portion of the first post such that the first post supports the first side edge portion of second panel insert.

9. The fence system of claim 1, in which at least one stiffening member is arranged within the second rail chamber of at least one of the upper and lower rails.

10. A method of forming a fence system comprising the steps of:

providing upper and lower rails each comprising:

an elongated hollow body comprising opposing longitudinally-extending first and second side wall portions and opposing longitudinally-extending upper and lower walls defining an inner cavity, an interior barrier extending between the first and second side wall portions to define a first chamber and a second chamber, where:

a rail opening is formed in a respective one of the upper and lower walls of each of the upper and lower rails and extends into the inner cavity thereof, in which each rail opening is a slit that extends along the entire length of each of the upper and lower rails, such that portions of the respective upper or lower wall on opposing sides of the slit and extending from the first and second side wall portions of each of the upper and lower rails define first and second flaps, respectively, where the rail opening is between the first and second flaps, and each of the upper and lower rails is configured such that the first and second side wall portions cause inward deflection of each of the first and second flaps toward each other;

providing a plurality of posts;

supporting ends of the upper and lower rails on the plurality of posts; and arranging a panel insert such that:

an upper edge portion of the panel insert extends through the rail opening and into the first chamber of the upper rail such that:

the upper edge portion of the panel insert engages the interior barrier of the upper rail, and inward deflection of the first and second flaps by the first and second side wall portions of the upper rail grips the upper edge portion of the panel insert; and arranging the panel insert such that:

a lower edge portion of the panel insert extends through the rail opening and into the first chamber of in the lower rail such that:

the lower edge portion of the panel insert engages the interior barrier of the lower rail, and inward deflection of the first and second flaps by the first and second side wall portions of the lower rail grips the lower edge portion of the panel insert.

11. The method as recited in claim 10, further comprising the steps of:

forming at least one post opening in each of the plurality of posts; and arranging the panel insert such that side edge portions of the panel insert extend through at least one of the at least one post opening in first and second posts of the plurality of posts such that the side edge portions of the panel insert are supported by the by the first and second posts.

12. The method as recited in claim 11, further comprising the step of configuring at least one of the posts to grip at least one of the side edge portions of the panel insert that extend through at least one of the at least one post opening.

13. The method of claim 10, further comprising the step of:

arranging at least one stiffening member within the second rail chamber of at least one of the upper and lower rails.

14. A fence system comprising:

first and second rails, where;

each of the first and second rails comprises:

an elongated hollow body comprising opposing longitudinally-extending first and second side wall portions and opposing longitudinally-extending upper and lower walls defining an inner cavity, an interior barrier extending between the first and second side wall portions to define a first chamber and a second chamber, where:

a rail opening is formed in a respective one of the upper and lower walls of each of the first and second rails and extends into the inner cavity thereof, in which each rail opening is a slit that extends along the entire length of each of the first and second rails, such that portions of the respective upper or lower wall on opposing sides of the slit and extending from the first and second side wall portions of each of the first and second rails define first and second flaps, respectively, where the rail opening is between the first and second flaps, where:

each of the first and second rails is configured such that the first and second side wall portions deflect each of the first and second flaps inwardly towards each other;

first and second posts arranged to support the first and second rails; and a panel insert; wherein:

the panel insert is arranged with first and second edge portions thereof within the rail opening defined by the first and second rails, respectively, such that:

the inward deflection of the first and second flaps by the first and second side wall portions of each of the first and second rails grips the first and second edge portions of the panel insert that extend through the rail opening and into the first chamber of each of the first and second rails, and the first and second edge portions of the panel insert engage the interior barriers of the first and second rails when the first and second edge portions of the panel insert are gripped by inward deflection of the first and second flaps by the first and second wall portions of the first and second rails.

15. The fence system as recited in claim 14, in which each of the first and second posts defines at least one post opening, where the first and second posts are configured to grip third and fourth side edge portions of the panel insert that extend through the at least one elongate post opening in the first and second posts, respectively.

16. The fence system as recited in claim 14, in which each of the first and second posts engages the ground to support the fence system in a desired orientation relative to the ground.

17. The fence system as recited in claim 14, further comprising a third post that engages the ground, in which one of the first and second posts is rotatably supported by the third post such that the first and second posts, first and second rails, and panel insert form a gate assembly.

18. The fence system of claim 14, in which:

at least one stiffening member is arranged within the second rail chamber of at least one of the first and second rails.

* * * * *